United States Patent [19]

Hunt, Jr.

[11] 4,186,928

[45] Feb. 5, 1980

[54] BASKETBALL GAME

[75] Inventor: C. D. Hunt, Jr., Durham, N.C.

[73] Assignee: Tinker, Inc., Durham, N.C.

[21] Appl. No.: 920,549

[22] Filed: Jun. 29, 1978

[51] Int. Cl.[2] ..... A63F 3/02

[52] U.S. Cl. ..... 273/244; 273/288

[58] Field of Search ..... 273/244, 247

[56] References Cited

U.S. PATENT DOCUMENTS

| | | | |
|---|---|---|---|
| 439,425 | 1/1890 | Presbry | 273/244 |
| 1,102,954 | 3/1914 | Ries | 273/244 |
| 1,149,753 | 8/1915 | Hammett | 273/247 |
| 1,594,807 | 12/1926 | Wurth | 273/244 |
| 3,545,763 | 8/1970 | Seitz | 273/244 |
| 3,941,386 | 3/1976 | Nelson | 273/244 |
| 4,007,937 | 2/1977 | Casciano | 273/244 |

FOREIGN PATENT DOCUMENTS

| | | | |
|---|---|---|---|
| 675718 | 7/1952 | United Kingdom | 273/247 |
| 1448943 | 8/1976 | United Kingdom | 273/247 |

*Primary Examiner*—Richard C. Pinkham
*Assistant Examiner*—R. Carl Moy
*Attorney, Agent, or Firm*—B. B. Olive

[57] ABSTRACT

A simulated basketball game played by two players comprises a playing board having two simulated half-courts, color coded and lettered offensive and defensive positions in each half-court, corresponding color coded and lettered game pieces and a simulated ball providing each player with both an offensive and a defensive team in each half-court and a corresponding color and letter coded system of dials providing play and score opportunities simulating offensive and defensive style of play and situations encountered in the game of basketball.

2 Claims, 8 Drawing Figures

BASKETBALL GAME

BACKGROUND OF THE INVENTION

1. Field of the Invention

The invention is directed to a simulated basketball game.

2. Description of the Prior Art

Simulated basketball games having game boards, game pieces, and spinner dials for simulating offensive, defensive and other basketball play situations are known in the art. Examples of simulated basketball games are to be found in U.S. Pat. Nos. 1,115,893; 1,594,807; 2,421,220; 3,545,763; and 3,941,386.

Considering all of the cited prior art and all other similar simulated basketball games of which applicant is aware, no such simulated basketball game is known in which two players are allowed to play both an offensive as well as a defensive team and with a simple coded play board and dial system simulating play and score opportunities of the type encountered in offensive and defensive styles of play in the normal game of basketball.

SUMMARY OF THE INVENTION

The simulated basketball game of the invention in the described embodiment provides a game board with a simulated basketball court having two half-courts. In each half-court, five play areas labeled A, B, C, D and E are provided. A play area is considered as being a series of positions with the same alphabet designation. For example, play area A has 4 offensive positions 1A, 2A, 3A and 4A. Some of the play areas by color and letter code represent offensive play areas whereas others by color and letter code represent defensive play areas. Each offensive play area has at least four and in some instances five offensive play positions. The defensive play areas are limited to not more than three defensive play positions.

Each of the two persons playing the game has a defensive team in one half-court and an offensive team in the other half-court with each person's offensive team and defensive team being of the same color. A time zone is also designated in each half-court.

Each offensive team has two dials for each play area, one of which is designated as a movement dial and has an unevenly divided segmented face with position numbers and the same color code as the play area's positions. Each play area's dials are identified with the same alphabet as the play area between the offensive dials and the defensive dial. Each offensive team also has for each play area a shooter dial with a segmented dial face defining a score area and offensive and defensive positions color coded for determining rebound possession when a shot is unsuccessful. The defensive teams are also each provided with a movement dial for each play area and which has an unevenly divided segmented face which has position numbers and is color coded for the corresponding defensive positions.

Twenty-one game pieces are provided. One game piece represents the ball in play. Each person playing has ten game pieces representing five offensive members in one half-court and five defensive members in the other half-court of his teams. Each person playing thus has a team color coded and also has an offensive movement counter to designate the number of moves taken by the opponent before shooting, a time zone counter to designate the number of moves taken by the opponent when within the defending court's time zone and a score board to designate individual scores. The object is to score points by placing the ball on the opposing person's goal while preventing the opposing person from scoring. Each successful shot counts two points. The success of each shot is determined by a shooter dial. The winner is the first person to reach twenty points or some other agreed number of points.

DESCRIPTION OF THE PREFERRED EMBODIMENT

Figure 1:
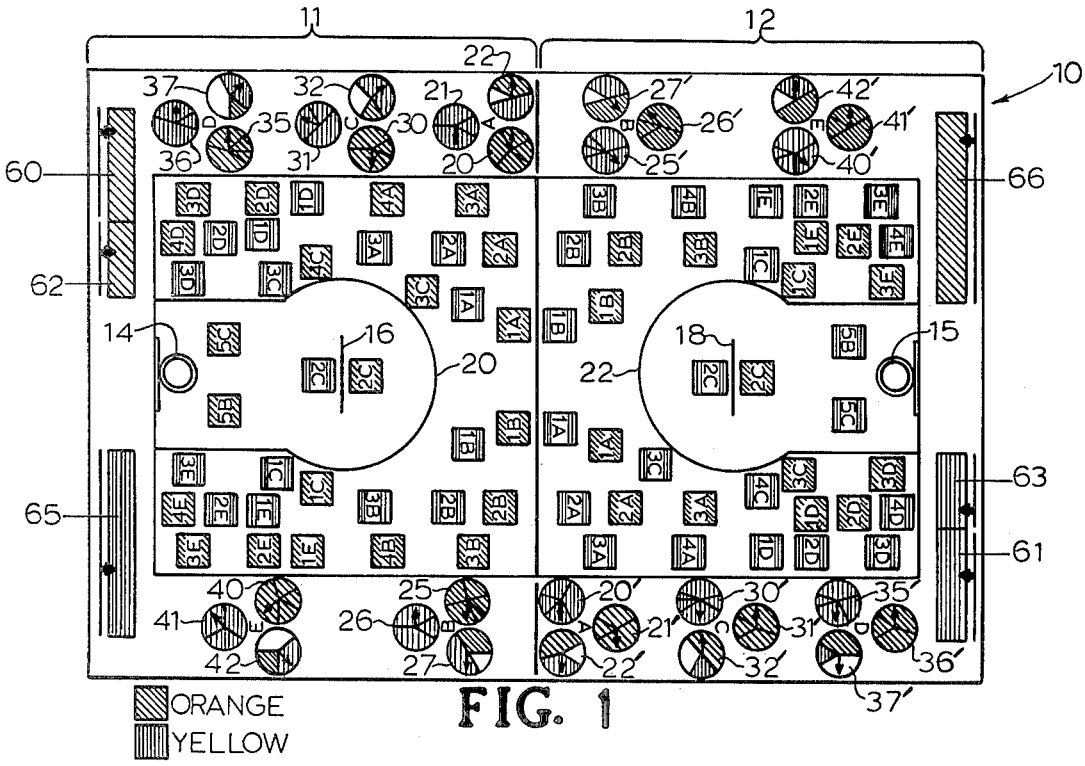
FIG. 1 is a plan view of a game board according to the invention.

The simulated basketball game of the invention is played by two persons, each of whom has ten players consisting of five offensive team players and five defensive team players. Thus, there are a total of twenty game pieces representing the twenty players and a single game piece representing the ball. The object of the game is to score points by placing the ball on the opposing person's goal while preventing the opposing person from scoring. Each successful shot counts two points. The type of move taken is determined by a movement dial and the success of each shot is determined by the shooter dial. The winner is the first person to obtain twenty points or some other agreed upon number of points.

With reference to the drawings, the game of the invention comprises a simulated basketball game board 10 having two half-courts 11 and 12 with respective goals 14, 15; foul lines 16, 18; and time zones 20, 22.

Each respective half-court is considered as having five play areas, A, B, C, D and E. Each play area has a designated number of color and number-letter coded team player locations to which the game pieces representing the team players are moved during play of the game. Thus, at the beginning of the game and according to the rules later explained, the twenty game pieces representing the twenty team players are placed on twenty such play area locations. Each half-court will have five such play pieces for each person playing the game so that each person has five players in each half-court and in one half-court such players will be on offensive designated locations and in the other half-court will be on defensive designated locations.

Play area A, for each half-court, has four offensive locations which, in half-court 11, are colored orange and are labeled 1A, 2A, 3A and 4A, respectively. For half-court 12, play area A also has four offensive locations but in this instance are colored yellow but with the same labels 1A, 2A, 3A and 4A, as best seen in FIG. 1. Play area A for half-court 11 also has three defensive locations colored yellow and which are respectively labeled 1A, 2A and 3A. Play area A for half-court 12 also has three defensive locations colored orange and which are respectively labeled 1A, 2A and 3A.

Play area B, for each half-court, has five offensive positions and three defensive positions. Referring again to FIG. 1, it will be noted with respect to half-court 11 that play area B has five offensive locations colored orange and labeled 1B, 2B, 3B, 4B and 5B, respectively. Also, in half-court 11 it will be seen that there are three defensive locations in play area B colored yellow and labeled respectively 1B, 2B and 3B. With respect to play area B, half-court 12 also has five offensive locations and three defensive locations. However, the play area B offensive locations in half-court 12 are colored yellow rather than orange but have similar labels, namely 1A, 2A, 3A, 4A and 5A as in half-court 11. Similarly, the three play area B defensive locations in half-court 12 are colored orange and are labeled 1B, 2B and 3B, respectively.

Having explained the color and number-letter coding system employed for play areas A and B, it appears sufficient to indicate that play area C has five offensive locations and three defensive locations. The play area C offensive locations are colored orange for half-court 11 and yellow for half-court 12 whereas the play area C defensive locations are colored yellow for half-court 11 and orange for half-court 12. In a similar manner, play area D will be seen as having four offensive locations and three defensive locations for each half-court. The play area D offensive locations are colored orange for half-court 11 and yellow for half-court 12 whereas the play area D defensive locations are colored yellow for half-court 11 and orange for half-court 12. Play area E has four offensive locations and three defensive locations with the offensive locations colored orange for half court 11 and yellow for half-court 12 with the defensive locations for play area being colored yellow for half-court 11 and orange for half-court 12.

It will be appreciated that the mentioned offensive and defensive locations for each of the play areas A, B, C, D and E are arranged so that offensive and defensive moves encounter various play situations intended to simulate passing, shooting or defending type play situations encountered in the game of basketball.

The twenty player game pieces on the board at all times also bear letter and color coding. In each half-court, each person playing will have five player game pieces of one color labeled A, B, C, D and E making a total of ten player game pieces all the same color. The other person playing will also have five player game pieces in each half-court, a total of ten player game pieces, but his color will be different from the color of his opponent. For example, one person playing will be assigned five player game pieces colored orange and labeled A, B, C, D and E for half-court 11 and the other person playing in the same half-court 11 will, for example, have five player game pieces colored yellow and labeled A, B, C, D and E. In the opposite half-court 12, the colors of the player game pieces would be the same but the color coded play areas will be reversed. As the rules later described will indicate, the game pieces representing the team players can only move to locations of the same color and letter. Thus, in effect, in each half court the offensive player game pieces in one play area can move only to locations designated offensive in that same play area of the respective half-court.

Each play area is provided with three dials or spinners, as illustrated in the drawings. The offense has what is considered in the game as a "movement" dial for each area. The defense has a movement dial only. The third dial is used by the offense as a so-called "shooter" dial. The offense movement dial indicates where the player game piece controlling the ball is to move. An offensive team player game piece has to shoot, pass, or move whereas a defensive team player game piece may move if he so desires but is not required to do anything.

Each movement dial has an appropriately colored face, corresponding to the color coded player game pieces and the color coded play area areas, and is divided into numbered segments. Referring to half-court 11, the three dials for play area A are respectively an offensive movement dial 20, a defensive movement dial 21 and a shooter dial 22. In half-court 11, the same respective and correspondingly colored dials for play area B are offensive movement dial 25, defensive movement dial 26 and shooter dial 27. Play area C in half-court 11 has a corresponding offensive movement dial 30, defensive movement dial 21 and shooter dial 32. Play area D has an offensive movement dial 35, defensive movement dial 36 and shooter dial 37. Play area E has an offensive movement dial 40, defensive movement dial 41 and shooter dial 42. Half-court 12 has a correspondingly similar set of offensive and defensive movement and shooter dials which in half-court 12 are indicated by using prime numbers of the dial numbers used in describing half-court 11.

Figure 2:
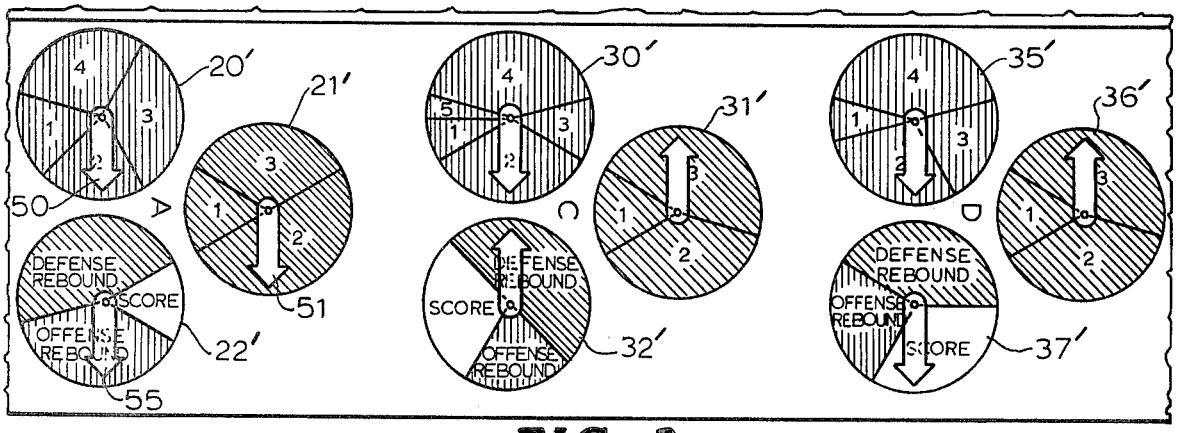
FIGS. 2 and 3 are enlarged fragmentary plan views of sets of dials provided for various number-letter and color coded offensive and defensive play areas on the game board for determining scoring and movements during offensive and defensive play of the game.

Enlargement of the sets of dials associated with player game pieces A, C and D and with half-court 12 are seen in FIG. 2. Using offensive movement dial 20' for play area A of half-court 12 as an example, it will be seen that this dial provides four possible segments labeled 1–4 on which its pointer 50 may come to rest. Defensive movement dial 21' has only three possible segments labeled 1–3 on which its pointer 51 may come to rest. The use of the movement dials is explained later. Referring next to half-court 12, play area A and shooter dial 22', it will be noted that pointer 55 of shooter dial 22 can reside when spun on either of three segments labeled "score", "offense rebound" and "defense rebound" respectively. As later explained, the various shooter score dials are used to determine the success of each shot and the team rebounding the ball when the shot is unsuccessful. Game interest is also substantially enhanced by the fact that the corresponding segments of the play area shooter dials, e.g., dials 27 and 42, are unequal. The opportunity to "score" with dial 42 is thus easier than with dial 27. Player game pieces C and D have similar sets of dials as also illustrated in FIG. 2. It should be noted here that offensive player game pieces A and D have four possible offensive moves but offensive player game piece C has five possible offensive moves as shown on movement dial 30'.

Figure 3:
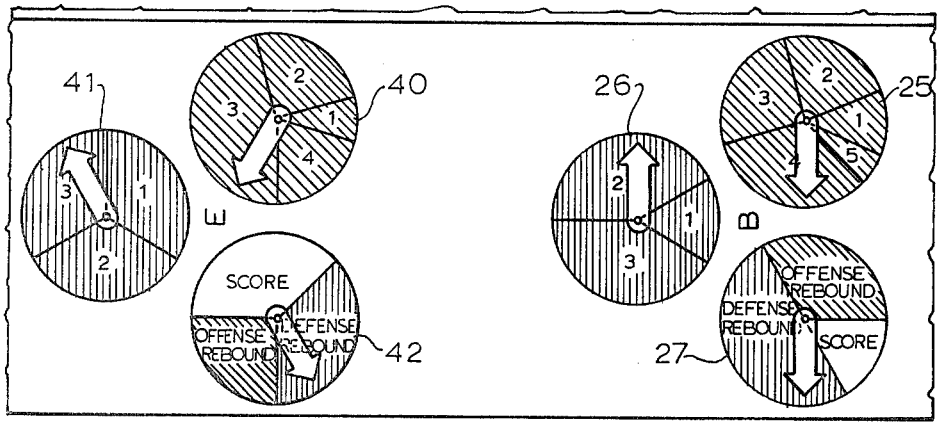

Enlargement of the sets of dials associated with player game pieces B and E and with half-court 11 are seen in FIG. 3. These movement and shooter dials are used in the same manner as the previously-described dials associated with player game pieces A, C and D. Mention is made here also that offensive game player B has five possible offensive moves as shown on movement dial 25.

Figure 5:
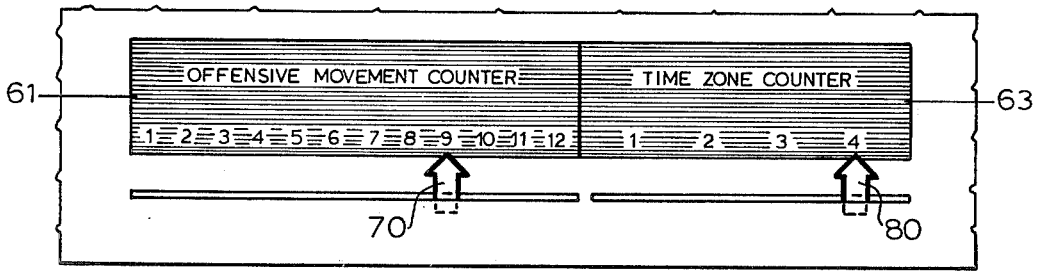
FIG. 5 is an enlarged fragmentary plan view of movement and time zone counters provided at each end of the board and which are color coded to correspond to opposing teams.

Game board 10 of the invention is also provided with a pair of offensive movement counters 60, 61; time zone counters 62, 63; and score boards 65, 66. As best seen in FIG. 5, offensive movement counter 61, used for illustration, has a movable pointer 70 and a scale 1–12 which is used to designate the number of moves taken by the opponent before shooting since, as will be pointed out in the rules, a shot must be made within twelve movements or passes or the ball turns over to the opposing team. As also seen in FIG. 5, the time zone counter 63 used for illustration has a pointer 80 and a scale 1–4 which is used to designate the number of offensive moves taken by the opponent when he has an offensive player within the defending court's time zone. This also will be elaborated upon in the rules, since an offensive player cannot stay in the time zone for more than four plays without a shot being taken.

Figure 4:
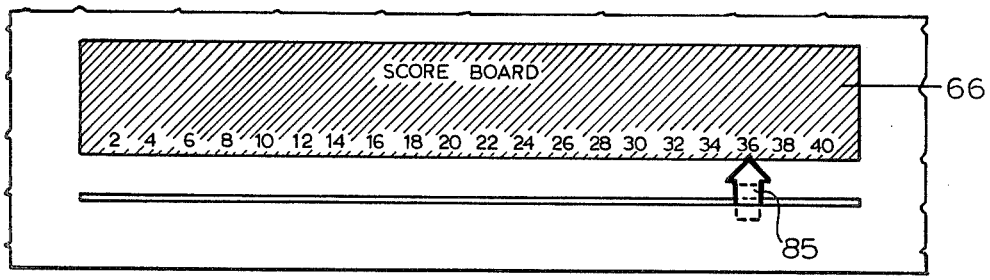
FIG. 4 is an enlarged fragmentary plan view of a scoreboard provided at each end of the game board for recording the score, one scoreboard being color coded to correspond to one team and the other being of a separate color corresponding to the opposing team.

Score board 66 used for illustration in FIG. 4 has a sliding pointer 85 and a suitable scale illustrated as 2–40 to keep track of the score. Each field goal is treated as counting two points and some previously agreed upon total score is used to determine the winner between the two persons playing the game.

As previously mentioned, the game involves use of twenty player game pieces color coded for opposing teams and lettered to correspond with the respective offensive and defensive play areas. Each of the two persons playing the game has a color coded team of ten players, five for offensive use and five for defensive use. A ball game piece 92 is also employed (see FIG. 8).

Figure 7:
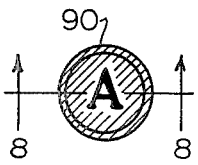
FIG. 7 is an enlarged plan view of one of the game pieces.
Figure 8:
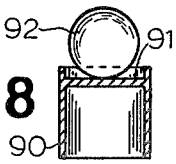
FIG. 8 is a section view taken substantially along line 8—8 of FIG. 7 and with a game piece simulating a ball placed on top of a player game piece.

FIGS. 7 and 8 illustrate an inverted cylindrical casing structure 90 provided as a player game piece and having a hollowed out upper void 91 adapted to hold the ball game piece 92. Each such player game piece 90, of course, is color coded for each team and is lettered to correspond with a designated play area letter, e.g., letter A as in FIG. 7 on which the player game piece is moved.

Prior to describing how the game is started and played, the following set of rules is set forth as an example of a suitable set of rules for playing on the described game board 10.

OFFENSIVE RULES

1. The ball is put into play by placing it on top of either player on position 1A or 1B.
2. The ball must be placed on the goal within 12 moves.
3. Each change from one position to another counts as one move.
4. Each player's movement dial may be redialed once when it stops on the same position occupied.
5. An offensive player may pass to another offensive player only when the ball can move in a straight line from the passer to the receiver without crossing a defensive player.
6. Offensive Shooting Rules
   (a) Only players in play areas A and B may shoot from any position when unchecked.
   (b) Players in play areas B and C have an automatic 2 points when it is moved to position 5B or 5C with the ball. If either player is moved to position 5B or 5C without the ball but is later passed it, then play area E's shooter dial will be used to determine the outcome of the shot for the player on 5B and play area D's shooter dial will be used to determine the outcome of the shot for the player on 5C.
   (c) Play area C's player can shoot only from:
      (i) Position 2C and the corresponding defensive player is on any position other than 2C.
      (ii) Position 4C and the corresponding defensive player is on any position other than 3C.
      (iii) Position 5C (unchecked position).
   (d) Play area D's player can shoot from:
      (i) Position 1D and the corresponding defensive player is on position 3D.
      (ii) Position 2D and the corresponding defensive player is on any position other than 1D.
      (iii) Position 3D and the corresponding defensive player is on any position other than 2D.
      (iv) Position 4D and the corresponding defensive player is on any position other than 3D.
   (e) Play area E's player can shoot only from:
      (i) Position 1E and the corresponding defensive player is on position 3E.
      (ii) Position 2E and the corresponding defensive player is on any position other than 1E.
      (iii) Position 3E and the corresponding defensive player is on any position other than 2E.
      (iv) Position 4E and the corresponding defensive player is on any position other than 3E.
7. Offensive Scoring and Rebounding Rules Each offensive player area has a shooter dial which determines the success of each shot and the team rebounding the ball when the shot is unsuccessful. Possession of the rebounds are determined by the dial stopping on the respective team's color. To score, the ball must be placed on the goal. Then the play area's shooter dial is spun. If it stops on score, two points are gained. If it stops on one of the other alternatives, the team rebounding the ball resumes play on position 1A or 1B of the offensive court of that particular team.

8. Offensive Time Zone Rules

Players in play areas B and C must be out of the time zone (position 5B for play area B and position 2C and 5C for play area C) by the end of the fourth offensive move.

DEFENSIVE RULES

1. General Defensive Rules
   (a) Either dial a move or pass and remain on the same position.
   (b) Redial once when the dial stops on the same position occupied.
   (c) Dial a move after each offensive pass.
2. Defensive Checked Rules An offensive player is checked when its corresponding defensive player occupies a position that prohibits shooting and passing.

3. Defensive Turnover Rules

Defense becomes offense when the offense violates:
   (a) the twelve move rule,
   (b) the time zone rule,
   (c) the shooting rules, or
   (d) when the shooter dial stops on the defensive rebound color code (defensive play areas position color).

After each turnover or score, the offense and the defense have the option of placing each player on any position within its play areas excluding the player on position 1A or 1B with the ball and positions 5B and 5C.

PLAYING THE GAME

Figure 6:
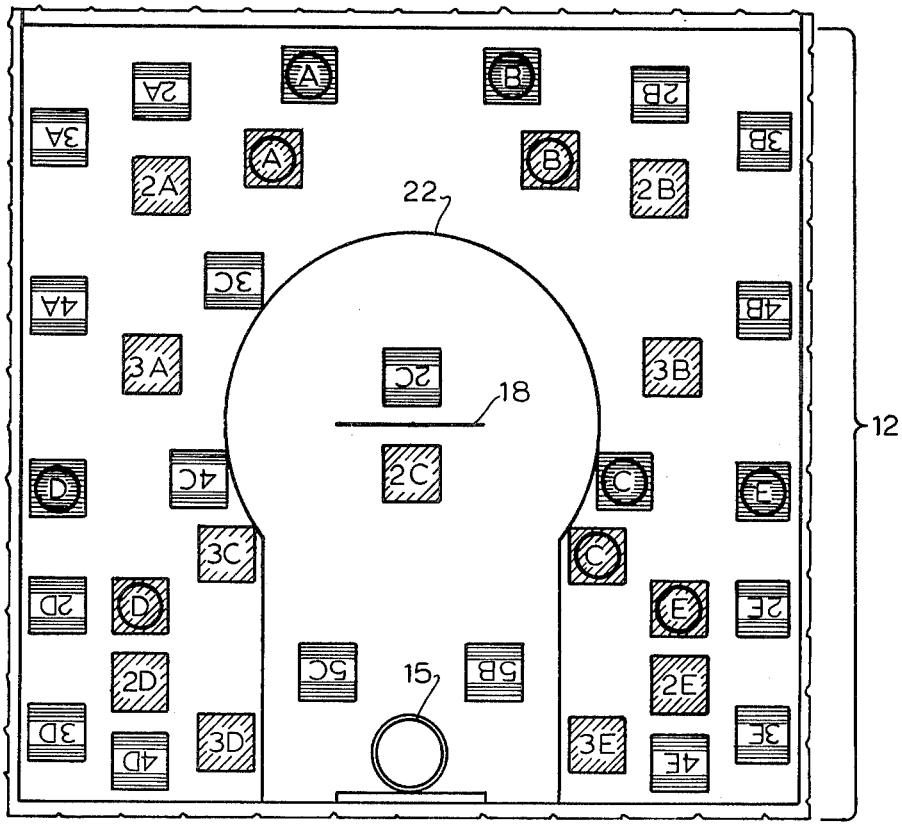
FIG. 6 is an enlarged fragmentary plan view of a half-court and showing five offensive and five defensive play pieces representing two teams playing the game.

To begin the game, each player game piece 90 must be placed on a number-letter coded position within its designated play area, for example, as illustrated by FIG. 6. Each person will have five offensive players on his opponent's end of the court and five defending players on his own end of the court.

EXAMPLE, Offensive play area - Players Location

"C" A player is placed on either position 1C, 2C, 3C or 4C (5C is excluded)

"D" A player is placed on either position 1D, 2D, 3D or 4D

"E" A player is placed on either position 1E, 2E, 3E, or 4E

This same procedure applies to play areas A and B with two exceptions: (1) an offensive player on play area A or B must be placed on position 1A or 1B and the ball put on top of this player to begin play, (2) the player on play area "B" can not begin play on position 5B.

The defending players may be placed on either of its three positions in each play area. For example, the defensive player on play area "A" can be placed on either position 1A, 2A or 3A. This same procedure applies to defensive play areas B, C, D and E, respectively.

After each half-court has been set up, the player in play areas A or B on position 1A or 1B with the ball begins the series by either passing the ball (placing it on another offensive player) or spinning its movement dial to change position. After the offense has passed or moved, the defense has option to spin its defensive movement dial and move a player or give up the dial and remain on the same position. The offense and defense alternate moves during the course of the game.

What is claimed is:

1. A basketball game comprising:

(a) a game board provided with a field of play having a defined pair of half-courts each with a foul line, goal and time zone designations, each said half-court having indicated thereon a selected plurality of player positions some of which are designated offensive by one color and some of which are designated defensive by a contrasting color and with each such position having a number selected from the numbers 1–5 and being additionally designated as belonging to one of five play areas within the respective court and identified by respective letters A–E, selected offensive-defensive positions in each half-court being positioned within said defined time zone and the same and other selected offensive-defensive positions being located to simulate offensive positions and defensive interference to offensive movements, passes or shots during play of the game;

(b) for each play area in each said half-court, a set of three pointer dial means located outside the boundaries of said half-courts and field of play, one of said dial means in each said set having an offensive color designated face and a preselected number of unequal segments numerically labeled 1, 2, 3, 4, or 5 to correspond to an available player position, another of said dial means in each set having a defensive color designated face and three unequal segments numerically labeled 1, 2, or 3 and the third said dial means of each said set having a face with a first segment having an offensive color designation labeled "offense rebound", a second segment having a defensive color designation labeled "defense rebound" and a third segment devoid of either offensive or defensive coloring and labeled "score," the size of said various segments being of predetermined varying size;

(c) a set of twenty player game pieces representative of two opposing sets of teams for each said half-court, ten being of one color and ten of a second color designation, each said player game piece being adapted to loosely receive a ball game piece thereon and each having a letter designation corresponding to one of said letter designated play areas; and (d) a game piece representative of the ball and adapted to loosely mount on any one of said player game pieces.

2. A basketball game as claimed in claim 1 having at each end of said game board and outside the boundaries of said half-courts and field of play sets of horizontal scale-sliding pointer means including at one end of the game board:

(a) a first horizontal scale-sliding pointer means designated by one team's coloring and labeled "offensive movement counter" and scaled 1–12;

(b) a second horizontal scale-sliding pointer means designated by one team's coloring and labeled "time zone counter" and scaled 1–4;

(c) a third said horizontal scale-sliding pointer means designated by one team's coloring labeled "score board" and scaled, by intervals of two to some predetermined number; and (d) at the opposite end of said game board and located outside the boundaries of said half-courts and field of play a similar set of three horizontal scale sliding pointer means but of the opposing team's color designation.

* * * * *